United States Patent [19]

Watanabe

[11] Patent Number: 4,645,192

[45] Date of Patent: Feb. 24, 1987

[54] SHEET FEEDER

[75] Inventor: Junji Watanabe, Yokohama, Japan

[73] Assignee: Kabushiki Kaisha Toshiba, Kawasaki, Japan

[21] Appl. No.: 778,501

[22] Filed: Sep. 20, 1985

[30] Foreign Application Priority Data

Sep. 27, 1984 [JP] Japan ..... 59-202741

[51] Int. Cl.[4] ..... B65H 3/44

[52] U.S. Cl. ..... 271/9; 271/10; 271/114; 271/242; 271/246

[58] Field of Search ..... 271/9, 10, 114, 242, 271/246, 266

[56] References Cited

U.S. PATENT DOCUMENTS

| | | | |
|---|---|---|---|
| 2,385,581 | 9/1945 | Küry | 271/266 |
| 3,563,533 | 2/1971 | Limberger | 271/114 X |
| 4,337,935 | 7/1982 | Sawada | 271/242 X |
| 4,516,764 | 5/1985 | Tamura | 271/114 X |

*Primary Examiner*—Richard A. Schacher

*Attorney, Agent, or Firm*—Cushman, Darby & Cushman

[57] ABSTRACT

A sheet feeder for feeding sheets one by one to a transfer path comprises feed rollers, aligning rollers, and a motor. Clutch mechanisms for transmitting the rotation of the motor are arranged individually between the motor and the feed rollers, and between the motor and the aligning rollers. Each of the clutch mechanisms includes a pair of connectors formed with mating indentations, the connectors being adapted for engagement with or disengagement from each other when the motor is stopped.

6 Claims, 6 Drawing Figures

FIG. 4
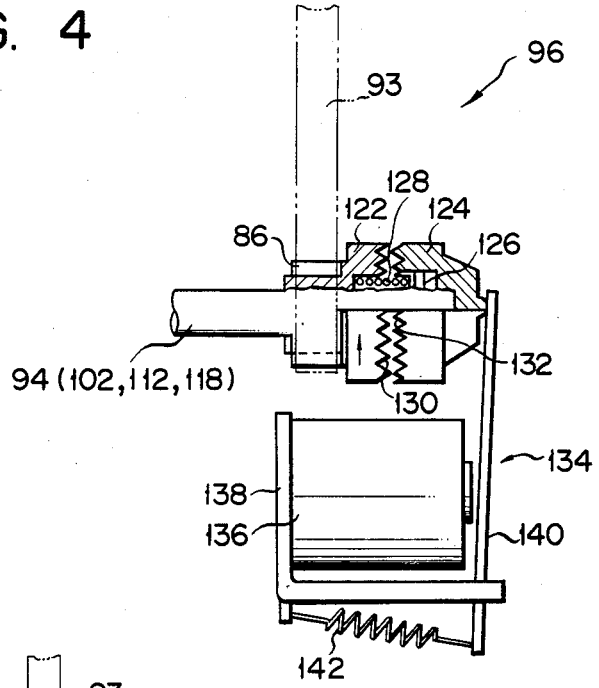
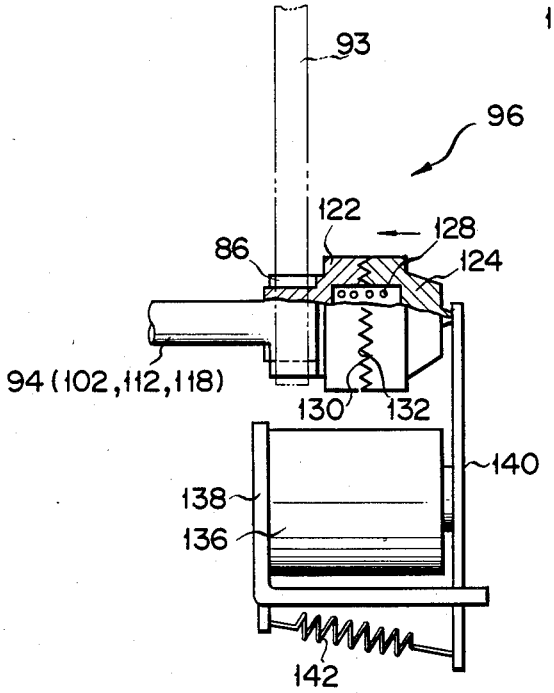
FIG. 5

SHEET FEEDER

BACKGROUND OF THE INVENTION

1. Field of the Invention

The present invention relates to a sheet feeder for feeding paper sheets, and, more specifically to a sheet feeder for feeding copying paper to a developing unit of a copying machine.

2. Description of the Prior Art

In a sheet feeder of this type, a plurality of paper sheets previously stored in a sheet cassette are fed one by one to a photosensitive body, as a developing unit, during a copying operation, so that a copied image is formed on each paper sheet. Such a sheet feeder comprises a paper-supply roller for taking the paper sheets out of the sheet cassette, and a pair of aligning rollers for lining the sheets up before they are delivered to the developing unit. After being taken out of the sheet cassette by the paper-supply roller, each paper sheet is temporarily stopped by the aligning rollers to have its leading edge lined up. After the leading edge of the paper sheet is lined up, the aligning rollers are driven so that the sheet is delivered to the developing unit.

In the conventional sheet feeder constructed in this manner, the paper-supply roller and the aligning rollers are driven independently, and are alternatively started or stopped. According to this sheet feeder, however, the paper-supply roller and the aligning rollers are driven by a single, common motor. Thus, the sheet feeder unit is provided with a drive mechanism actuated by a single motor; and the paper-supply roller and the aligning rollers are fitted individually with clutches which can be coupled to the drive mechanism. As the clutches are alternatively coupled to the drive mechanism, the driving force is transmitted to either the paper-supply roller or the aligning rollers. Conventionally, electromagnetic clutches or spring clutches (one-way clutches) have been used for this purpose. Electromagnetic clutches, however, are expensive and may sometimes be subject to slippage in a connected state, attributable to the wear of clutch plates, while with spring clutches, a spring is normally in sliding contact with the driving-side shaft of the clutch such that it is liable to wear or fatigue, resulting in a diminishment of its resiliency. In some cases, therefore, spring clutches may fail to transmit the driving force when connected.

Thus, the driving force of the motor cannot be securely transmitted to the paper-supply roller and the aligning rollers, so that the paper sheets cannot be securely fed from the sheet feeder. This would necessitate the use of more expensive clutches, resulting in increased cost of the sheet feeder.

SUMMARY OF THE INVENTION

The object of the present invention is to provide a sheet feeder whose cost is reduced and whose capacity to feed paper sheets is secure.

According to an aspect of the present invention, there is provided a sheet feeder for feeding sheets one by one along a transfer path, which comprises feed roller means for delivering and feeding the sheets to the transfer path, aligning roller means disposed in the transfer path and adapted to align each sheet fed along the transfer path, a drive source for supplying power to the feed roller means and the aligning roller means, clutch means arranged between the drive source and both the feed roller means and the aligning roller means, and adapted to intermittently transmit the driving force of the drive source to the feed roller means and the aligning roller means, the clutch means including a pair of connectors formed individually with sets of mating indentations, the pair of connectors being adapted for engagement with or disengagement from each other when the drive source is switched off.

BRIEF DESCRIPTION OF THE DRAWINGS

FIGS. 4 and 5 are partial sectional views illustrating the operation of a clutch used in the sheet feeder of FIG. 2.

DETAILED DESCRIPTION OF THE PREFERRED EMBODIMENT

An embodiment of the present invention will now be described in detail with reference to the accompanying drawings of FIGS. 1 to 6.

Figure 1:
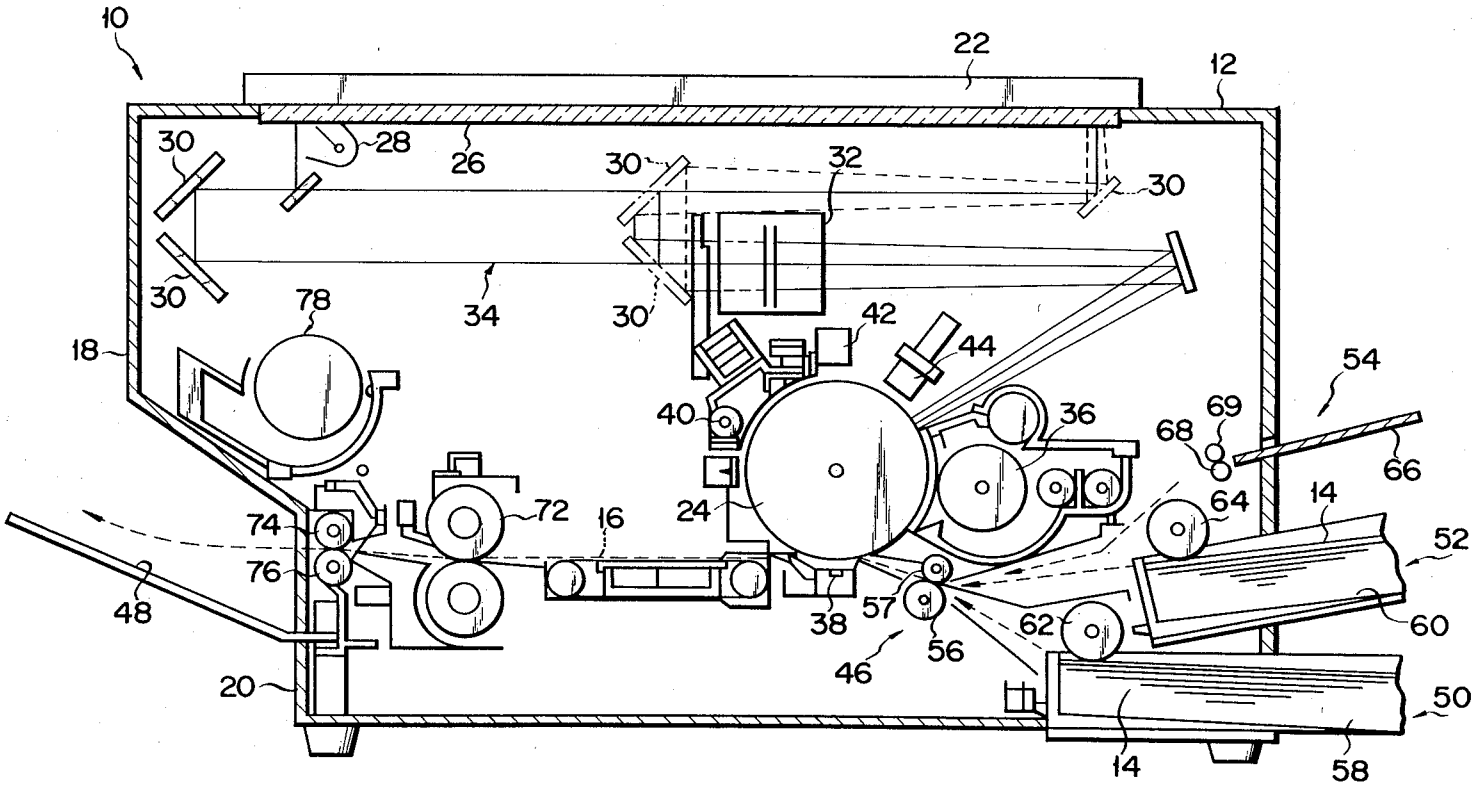
FIG. 1 is a schematic sectional view of a copying machine using a sheet feeder according to an embodiment of the present invention.

FIG. 1 shows an electronic copying machine 10 according to the embodiment of the invention. The electronic copying machine 10 has a housing or body 12 which consists of an upper unit (first housing) 18 and a lower unit (second housing) 20. The upper and lower units 18 and 20 are divided by a transfer path (indicated by broken line) 16 through which copying paper 14 is fed. Generally liable to jam, the conveyor path 16 may be exposed when the two units 18 and 20 are separated from each other. The body 12 carries thereon a turnable cover 22 which holds an original paper (not shown) designated for copying. A photosensitive body 24 is rotatably supported in the central portion of the interior of the body 12 so that an electrostatic latent image is formed on the surface of the photosensitive body 24 by a light beam applied thereto. Between the photosensitive body 24 and the cover 22 lies an exposure mechanism 34 which comprises an original table 26 on which is placed the original paper, a lamp 28 for irradiating the original table 26, mirrors 30 for reflecting a light beam from the original table 26 on the photosensitive body 24, and a lens unit 32 for reducing or magnifying images. Adjacent to the photosensitive body 24 is a developing device 36 for developing an electrostatic latent image formed on the photosensitive body 24 by applying a toner to the image, and a transfer device 38 for transferring a toner image on the surface of the photosensitive body 24 to the copying paper 14. Also adjacent to the photosensitive body 24 is a cleaning device 40 for removing the toner on the photosensitive body 24, a deelectrifier 42 for removing the electrostatic latent image on the photosensitive body 24, and a charger 44.

The starting end of the transfer path 16 is coupled to a sheet feeder (sheet feeding unit) 46 which is located at one side of the lower unit 20 to feed the copying paper 14 to the transfer path 16, while the extreme end of the transfer path 16 extends to an outlet tray 48 which receives discharged copies.

The sheet feeder 46 comprises a first cassette loading section 50, a second cassette loading section 52, a manual inserting section 54, and a pair of aligning rollers 56 and 57 for lining up copying paper sheets fed from any one of these sections. The first cassette loading section 50 is fitted with a first cassette 58 which stores copying paper sheets of one size, and the second cassette loading section 52 is fitted with a second cassette 60 which stores copying paper sheets of another size. The paper sheets are delivered alternatively from the cassette 58 or 60. The first cassette loading section 50 includes a first paper-supply roller 62 for feeding the paper sheets toward the aligning rollers 56 and 57. Likewise, the second cassette loading section 52 includes a second paper-supply roller 64. The manual inserting section 54 for inserting a sheet by hand is provided with a guide tray 66 and a pair of feed rollers 68 and 69 for feeding the paper sheet inserted along the guide tray 66 toward the aligning rollers 56. The first and second paper-supply rollers 62 and 64, the feed rollers 68 and 69, and the aligning rollers 56 and 57 are coupled to a drive mechanism 70 which will be described later with reference to FIG. 2 and 3.

A fixing device 72 for fixing the toner to the paper sheet and exit rollers 74 and 76 is arranged near the extreme end of the transfer path 16. A cooling fan unit 78 is disposed over the exit rollers 74 and 76.

Figure 2:
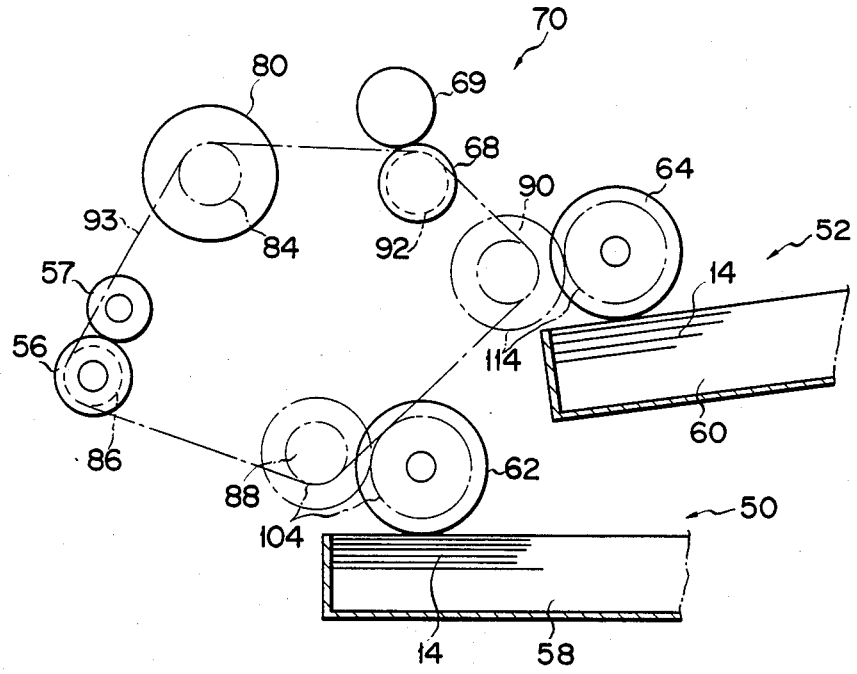
FIG. 2 shows an outline of the sheet feeder used in the copying machine of FIG. 1.
Figure 3:
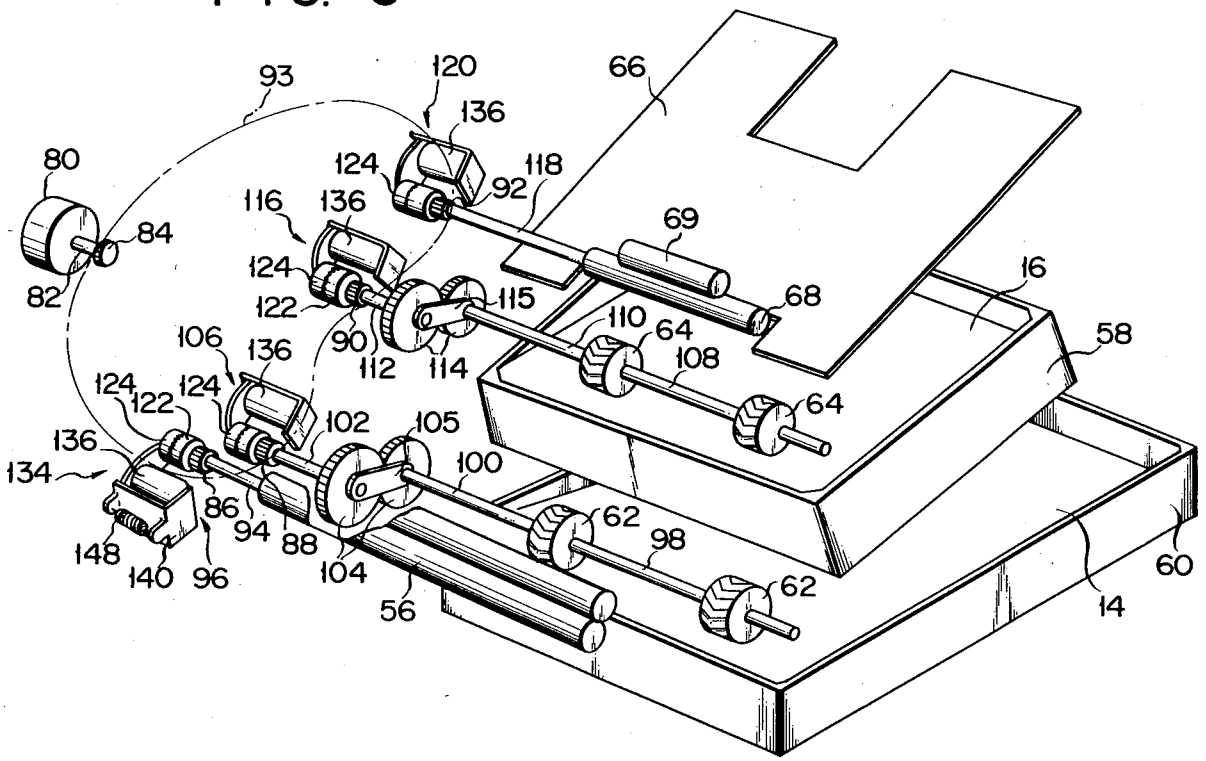
FIG. 3 is a perspective view schematically showing the construction of the sheet feeder of FIG. 2.

Referring now to FIGS. 2 and 3, the drive mechanism 70 for the sheet feeder 46 will be described in detail. The drive mechanism 70 includes a pulse motor 80 as a drive source, whose drive shaft 82 (shown in FIG. 3) is fitted with a driving pulley 84. The drive mechanism 70 further includes first, second, third, and fourth pulleys 86, 88, 90 and 92. A timing belt 93 is passed around the individual pulleys to transmit the driving force of the pulse motor 80. The first pulley 86 is mounted on a portion of one end of a shaft 94 of the aligning roller 56. This portion of the shaft 94 is fitted with a first clutch mechanism 96, whereby the driving force of the first pulley 86 is transmitted to or cut off from the aligning roller 56. The second pulley 88 is mounted on a portion of one end of a shaft 98 of the first paper-supply roller 62. The shaft 98 of the first paper-supply roller 62 is divided into two parts, a first shaft 100 mounted with the roller 62 and a second shaft 102 coupled to the first shaft 100 so as to rotate around the same.

The first and second shafts 100 and 102 are connected by means of a pair of gears 104 which mesh with each other. The two shafts 100 and 102 are also coupled by means of a link 105 so that the first shaft 100 can rotate around the second shaft 102. The second shaft 102 is fitted with a second clutch mechanism 106, whereby the driving force of the second pulley 88 is transmitted to or cut off from the first paper-supply roller 62. The third pulley 90 is mounted on a portion of one end of a shaft 108 of the second paper-supply roller 62, the shaft 108 of the second paper-supply roller 64 is divided into first and second shafts 110 and 112 which are coupled to each other by means of a pair of gears 114 and a link 115.

The second shaft 112 is fitted with a third clutch mechanism 116, whereby the driving force of the third pulley 90 is transmitted to or cut off from the second paper-supply roller 64. The fourth pulley 92 is mounted on a portion of one end of a shaft 118 of the feed roller 68 for manual feed. The shaft 118 of the feed roller 68 is fitted with a fourth clutch mechanism 120, whereby the driving force of the fourth pulley 92 is transmitted to or cut off from the feed roller 68.

Referring now to FIGS. 4 and 5, the clutch mechanisms will be described in detail. Since the first to fourth clutch mechanisms 96, 106, 116 and 120 are of the same construction, only the first clutch mechanism 96 will be described for the sake of brevity.

As shown in FIG. 4, the clutch mechanism 96 is provided with first and second connectors 122 and 124 which can engage each other. The first connector 122, which is formed integrally with the first pulley 86, is rotatably mounted on the shaft 94. On the other hand, the second connector 124 is coupled to the shaft 94 by means of a pin 126 so as to be slidable along the axial direction of the shaft 94 and fixed in the rotating direction of the shaft 94. A coil spring 128 is interposed between the first and second connectors 122 and 124. The coil spring 128 normally urges the first and second connectors 122 and 124 to move away from each other. The first and second connectors 122 and 124 are formed with sets of teeth 130 and 132, on their respective facing sides.

The first and second connectors 122 and 124 are adjoined by an electromagnetic unit 134 which is adapted to connect the two connectors 122 and 124 so that they might oppose urging force of the spring 128. The electromagnetic unit 134 includes an electromagnet 136 wound with a coil, and an L-shaped support frame 138 for supporting the electromagnet 136. A portion of the proximal end of an armature 140 is rockably attached to the support frame 138, while a portion of its distal end abuts against the second connector 124. The electromagnet 136 is arranged opposite the middle portion of the armature 140; and a spring 142 is fixed to a portion of the proximal end of the armature 140. Thus, the spring 142 urges the middle portion of the armature 140 to separate from the electromagnet 136.

When the electromagnet 136 is excited in the above-mentioned arrangement of the clutch mechanism, the armature 140 rocks against the urging force of the spring 142 so that the distal end portion of the armature 140 presses on the second connector 124, as shown in FIG. 5. Then, the second connector 124 slides along the axis of the shaft 94 against the urging force of the spring 128, thereby engaging the first connector 122. As a result, the rotation of the first pulley 86 is transmitted to the shaft 94 of the aligning roller 56. Having their teeth 130 and 132 engaged, in this case, the first and second connectors 122 and 124 are securely connected without possibility of slipping.

The operation of the copying machine 10 using the sheet feeder 46 according to the present invention will now be described in detail.

In forming an image, the original paper on the original table 26 is scanned by the exposure mechanism 34, and a light beam reflected by the original paper is applied to the photosensitive body 24 through the mirrors 30 and the lens unit 32. By this irradiation, an electrostatic latent image responsive to the original image is formed on the surface of the photosensitive body 24 which is charged by the main charger 44. This electrostatic latent image is delivered to the developing device 36 where it is supplied, with developing agent, to be developed into a visible image. Thereafter, the image is transmitted to the transfer device 38.

Meanwhile, the paper sheet 14 from the sheet feeding unit has been supplied to the transfer device 38. Namely, the pulse motor 80 is started to drive the timing belt 93 so that the first to fourth pulleys 86, 88, 90 and 92, mounted, respectively, on the shafts of the aligning roller 56; the first and second paper-supply rollers 62 and 64, and the feed roller 68 begin rotating. When each of the clutch mechanisms is connected, the pulse motor 80 is caused to pause in this case. The timing for the start and stop of the pulse motor 80 and the connection and disconnection of the clutch mechanisms will be described in detail later.

If a desired clutch mechanism, e.g. the first clutch mechanism 96, is to be connected when the pulse motor 80 is stopped, the electromagnet 136 of the first clutch mechanism 96 is energized. Then, the excitation of the electromagnet 136 causes the armature 140 to be rocked against the urging force of the spring 142 by means of magnetic attraction. Thus, the armature 140 pushes the second connector 124 against the urging force of the spring 128. Accordingly, as shown in FIG. 5, the second connector 124 engages with the first connector 122, thereby connecting the clutch mechanism 96. As the clutch mechanism 96 is connected, the rotatory force of the first connector 122 is transmitted through the second connector 124 to the shaft 94, so that the aligning roller 56 is rotated. The second, third or fourth clutch mechanisms 106, 116 or 120 are alternatively and similarly connected.

Figure 6:
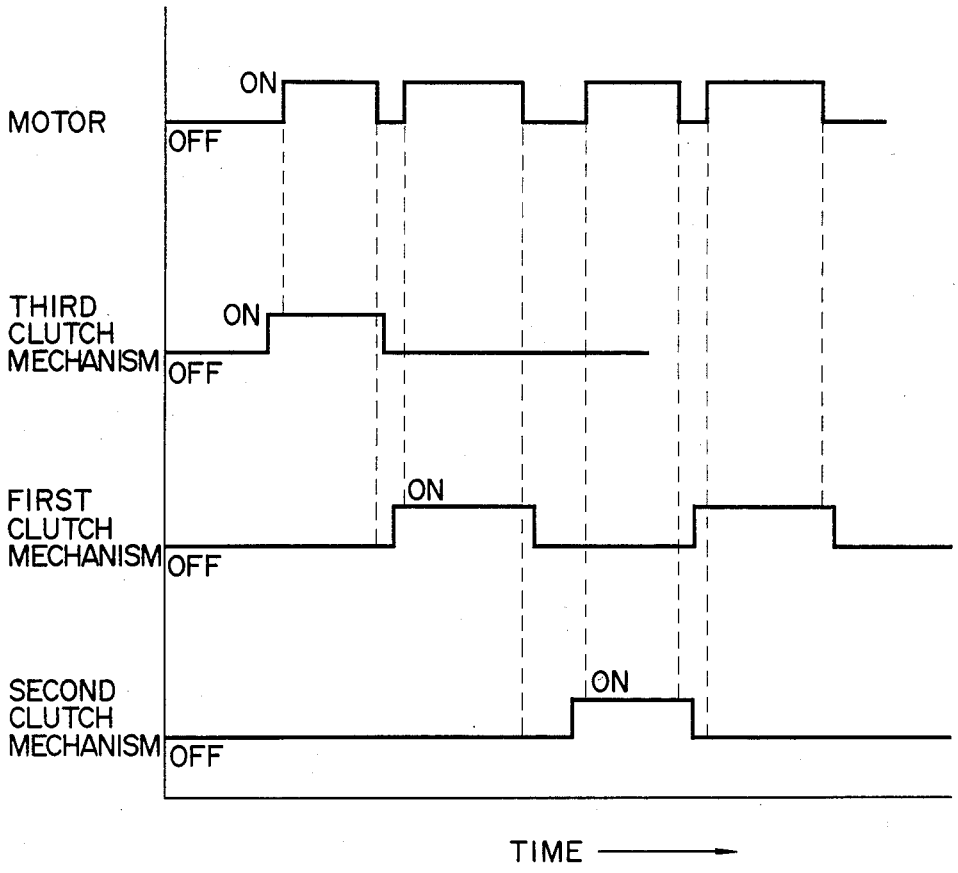
FIG. 6 is a timing chart of the sheet feeder of FIG. 2.

Referring now to FIG. 6, the timing for the operation of the motor 80 and the connection and disconnection of the clutch mechanisms will be described. In the timing chart of FIG. 6, the axis of abscissa represents time, while the axis of ordinate represents the timing for the operation of the motor 80 and the connection and disconnection of the second, third and first clutch mechanisms 106, 116 and 96 of the first and second paper-supply rollers 62 and 64, and the aligning roller 56. Since the fourth clutch mechanism 120 of the feed roller 60 has the same operating timing as the clutch mechanism of the first or second paper-supply roller 62 or 64, its description will be omitted. As seen from FIG. 6, the first and second connectors 122 and 124 of each clutch mechanism are connected when their teeth 130 and 132 engage, so that the motor 80 needs to be stopped at the time of connection or disconnection of the clutch mechanism. Thus, any of the clutch mechanisms is connected or disconnected only when the motor 80 is off. At the time of sheet feeding, the first clutch mechanism 96 (aligning roller 56) is connected at a predetermined time after any of the second, third and fourth clutch mechanisms 106, 116 and 120 is connected.

Thus, whether manually fed or automatically fed from the sheet cassette 58 or 60, the paper sheet 14, is delivered to the aligning rollers 56 and 57 to be lined up thereby, and then passed between the photosensitive body 24 and the transfer charger 38 so that an image on the photosensitive body 24 can be transferred to the sheet 14. Thereafter, the paper sheet 14 is delivered to the fixing device 72 where the image is fixed, after which the paper sheet 14 is discharged into the outlet tray 48 by the exit rollers 74 and 76.

According to the sheet feeder 46 of this embodiment, the clutch mechanisms for controlling the drive of the first and second paper-supply rollers 62 and 64, the feed roller 68, and the aligning roller 56 are connected through the engagement of their teeth, thus ensuring secure transmission of the driving force without a slip.

It is to be understood that the present invention is not limited to the embodiment described above, and that various changes and modifications may be effected therein by one skilled in the art without departing from the scope or spirit of the invention.

In the above embodiment, for example, the first and second paper-supply rollers and the manual feed rollers are used as feed rollers. Alternatively, however, only the first paper-supply roller may be used. In this case, paper sheets are fed from only one sheet cassette. Instead of being allowed to rotate in only one direction, moreover, the motor may be rotated in either direction as required. In case of jamming, for example, the aligning roller 56 can be reversed to clear the excess paper sheets.

In each clutch mechanism, according to the above embodiment, the first and second connectors are each formed with a plurality of teeth on their facing sides. Alternatively, however, the two connectors may be formed individually with mating indentations, e.g., a combination of a projected cross and a recessed cross which can engage each other.

Furthermore, the present invention is not limited to use as a sheet feeder in a copying machine, and may also be used as a bank note counter, a printing apparatus, etc.

What is claimed is:

1. A sheet feeder for feeding sheets one by one along a transfer path, comprising:

feed roller means for delivering and feeding the sheets to the transfer path;

aligning roller means disposed in the transfer path and adapted to align each sheet fed along the transfer path;

a drive source for driving the feed roller means and the aligning roller means, said drive source including a motor with a driving shaft; and clutch means arranged between the drive source and both the feed roller means and the aligning roller means, and adapted to selectively transmit the driving force of the drive source to the feed roller means and the aligning roller means, said clutch means including a pair of connectors formed individually with sets of mating indentations, said pair of connectors being adapted for engagement with or disengagement from each other when the drive source is switched off, wherein said mating indentations formed on the pair of connectors are tooth-shaped, one of said pair of connectors being connected to the feed roller means and the other of said pair of connectors being connected to the aligning roller means, said pair of connectors being disposed in parallel with the driving shaft of the motor.

2. A sheet feeder according to claim 1, wherein said clutch means is provided with a spring means for urging the pair of connectors to separate from each other, and an electromagnetic unit, adapted, when energized, to cause the connectors to engage each other in opposition to the urging force of the means.

3. A sheet feeder according to claim 1, wherein said feed roller means includes two rollers adapted to take out sheets of one size from cassette means.

4. A sheet feeder according to claim 3, wherein said feed roller means further includes manual insertion guide rollers for delivering manually fed sheets to the transfer path.

5. A sheet feeder according to claim 1, wherein said sheet feeder is used for feeding copying paper to a copying machine.

6. A sheet feeder for feeding sheets one by one along a transfer path, comprising:

feed roller means for delivering and feeding the sheets to the transfer path;

aligning roller means disposed in the transfer path and adapted to align each sheet fed along the transfer path;

a drive source for driving the feed roller means and the aligning roller means, said drive source including a motor with a driving shaft;

clutch means arranged between the drive source and both the feed roller means and the aligning roller means, and adapted to selectively transmit the driving force of the drive source to the feed roller means and the aligning roller means, said clutch means including a pair of connectors formed individually with sets of mating indentations, said pair of connectors being adapted for engagement with or disengagement from each other when the drive source is switched off, one of said pair of connectors being connected to the feed roller means and the other of said pair of connectors being connected to the aligning roller means, said pair of connectors being disposed in parallel with the driving shaft of the motor, said clutch means connecting the feed roller means and then the aligning roller means to the motor, thereby allowing selective transmission of the driving force of said motor.

* * * * *